US005449562A

United States Patent [19]

Coulon

[11] Patent Number: 5,449,562

[45] Date of Patent: Sep. 12, 1995

[54] COATING FOR PORTIONS OF A PART OF MARTENSITIC STEEL THAT RUB IN ROTATION

[75] Inventor: André Coulon, Bessoncourt, France

[73] Assignee: GEC Alsthom Electromecanique SA, Paris, France

[21] Appl. No.: 131,950

[22] Filed: Oct. 8, 1993

[30] Foreign Application Priority Data

Oct. 9, 1992 [FR] France ..... 92 12021

[51] Int. Cl.[6] ..... B22F 7/00

[52] U.S. Cl. ..... 428/552

[58] Field of Search ..... 428/552; 106/1.05; 75/240

[56] References Cited

U.S. PATENT DOCUMENTS

| | | | |
|---|---|---|---|
| 3,617,358 | 11/1971 | Dittrich | 117/105.2 |
| 3,941,903 | 3/1976 | Tucker, Jr. | 427/190 |
| 3,971,633 | 7/1976 | Wolfla et al. | 29/195 |
| 4,173,457 | 11/1979 | Smith | 51/309 |
| 4,275,124 | 6/1981 | McComas et al. | 428/564 |
| 4,290,510 | 9/1981 | Warren | 188/218 XL |
| 4,334,927 | 6/1982 | Hyde et al. | 75/240 |
| 4,510,183 | 4/1985 | Akyol | 427/185 |
| 4,584,081 | 4/1986 | Coulon | 204/272 |
| 4,606,948 | 8/1986 | Hajmrle et al. | 427/423 |
| 4,731,253 | 3/1988 | DuBois | 427/34 |
| 4,756,841 | 7/1988 | Buran et al. | 252/26 |
| 5,079,100 | 1/1992 | Descamp et al. | 428/552 |
| 5,137,422 | 8/1992 | Price et al. | 415/200 |

OTHER PUBLICATIONS

Patent Abstracts of Japan, vol. 9, No. 160 (C-289)(1883) Jul. 4, 1985 & JP-A-60 033 364 (Kouei Seikou) Feb. 20, 1985.

*Primary Examiner*—Donald P. Walsh
*Assistant Examiner*—Scott T. Bluni
*Attorney, Agent, or Firm*—Sughrue, Mion, Zinn, Macpeak & Seas

[57] ABSTRACT

A surface coating (6) on martensitic steel for portions that rub by rotation is characterized in that it comprises a matrix (9) of NiMo in which grains of $Cr_3C_2$ are embedded, 90% of which by weight are constituted by grains (8) in the range 10 μm to 30 μm. The coating has a low coefficient of friction and good adhesion.

4 Claims, 1 Drawing Sheet

COATING FOR PORTIONS OF A PART OF MARTENSITIC STEEL THAT RUB IN ROTATION

The present invention relates to a surface coating on martensitic steel for portions that rub in rotation.

Martensitic steels, and in particular those that contain 9 weight % to 18 weight % chromium are highly sensitive to seizing. Comparative tests have shown that the rubbing behavior of such steels compared with that of ferritic steels is so different that surface treatment is necessary, particularly when the mechanical part concerned is in rotation and rests on a journal bearing or on an abutment. The slightest defect in lubrication can give rise to almost instantaneous damage to the load-bearing journals.

For a turbine rotor made of martensitic steel, such treatment is absolutely essential and avoids any risk of seizing.

It is already known to coat the rubbing surfaces with chromium, however depositing such a coating is relatively expensive and requires a special installation.

The coating of the present invention having a low coefficient of friction and good adhesion and that is easy to deposit is characterized in that it comprises a matrix of NiMo in which grains of $Cr_3C_2$ are embedded. It is important for the matrix to include no chromium since that would make the matrix fragile.

The grains of $Cr_3C_2$ serve to impart hardness to the ductile NiMo matrix.

The composition by weight of the coating is preferably as follows:

$Cr_3C_2$: 15% to 25%;

Mo: 15% to 25%;

Ni: 55% to 65%.

The grain size of the NiMo matrix is 20 μm to 90 μm.

In an advantageous improvement of the invention, the $Cr_3C_2$ contains 2% by weight of submicron-sized grains. These grains are to be found for the most part in the vicinity of the surface and they perform a protective role by providing a kind of dry lubrication.

The invention is described in greater detail with reference to the particular embodiments given by way of non-limiting example and shown in the accompanying drawing.

Figure 1:
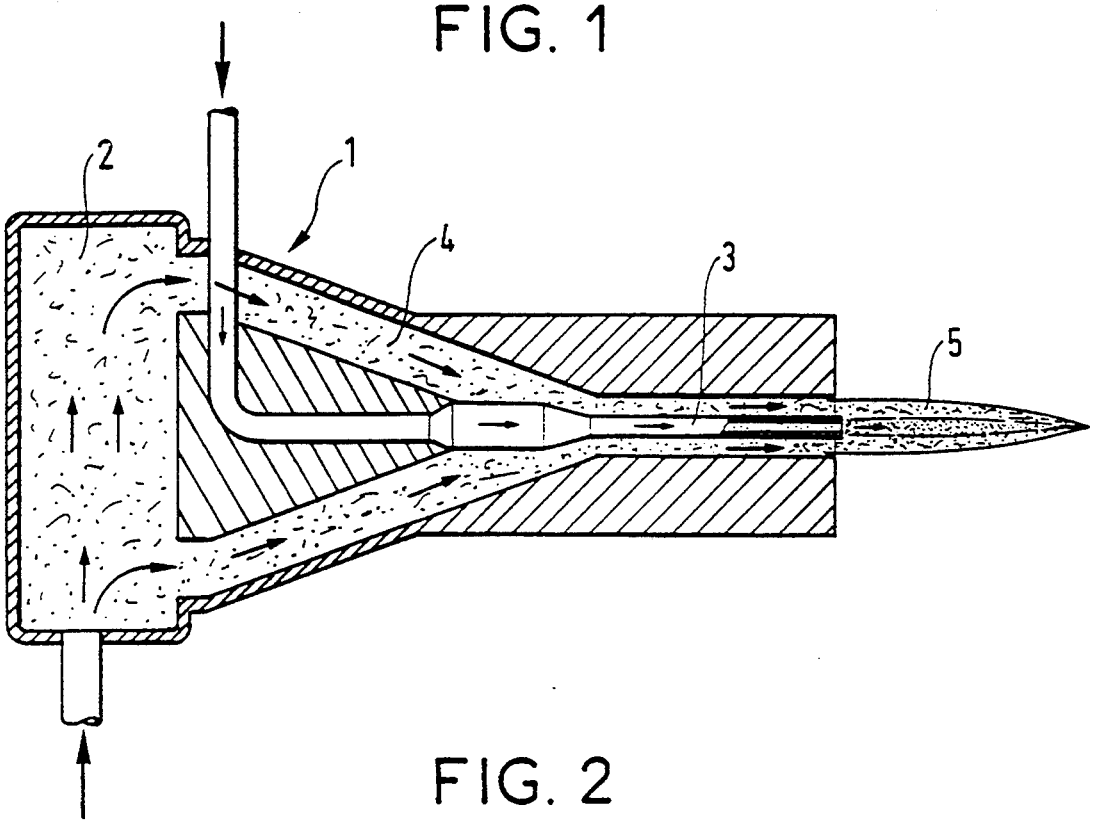
FIG. 1 is a diagram of a device for depositing a coating of the invention.

The torch 1 shown in FIG. 1 comprises a combustion chamber 2 fed with a gaseous mixture that includes propane, oxygen, hydrogen, and nitrogen, and a central tube 3 that is fed with a powder mixture.

The gas mixture passes from the chamber 2 into a duct 4 surrounding the tube 3.

The end of the duct 4 and the end of the tube 3 open to the outside where a flame 5 is produced. The powder passes through the flame and is projected at high speed by the carrier gas.

The part to be coated (not shown) is located a short distance (200 mm to 400 mm) from the torch and the torch moves relative to the part by means of an automatic advance system.

In its application to a turbine rotor, the rotor is mounted on a horizontal lathe and is rotated slowly.

The way in which surfaces to be coated are prepared is known to the person skilled in the art: degreasing followed by burning, and sandblasting to facilitate mechanical keying of the coating.

The powder is projected hot in dynamic mode: with the rotor in rotation, the torch is displaced horizontally for the journals of the rotor, or vertically for its abutment faces. The optimum thickness of the coating lies in the range 30 μm to 60 μm.

The powder is a special alloy, particularly adapted to an application with turbine rotors.

The powder mixing proportions are as follows (in % by weight):

$Cr_3C_2$: 20%±5%

Ni: 60%±5%

Mo: 20%±5%

The grain size of the powder must be selected so that at least 90% by weight of the chromium carbide used is obtained from submicron-sized spherical $Cr_3C_2$ which is then consolidated and sintered to a size in the range 10 μm to 30 μm.

The grain size of the NiMo mixture should lie in the range 20 μm to 90 μm.

Figure 2:
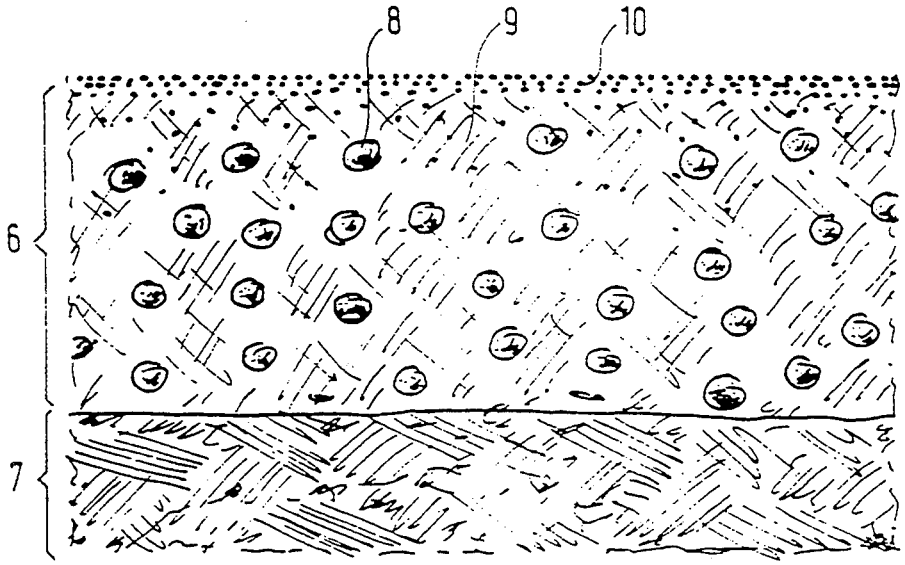
FIG. 2 shows a coating of the invention.

The coating 6 on the part 7 (see FIG. 2) includes large sintered grains 8 of $Cr_3C_2$ that import hardness to the coating. The NiMo matrix 9 made up of 20 μm to 90 [m grains is ductile so that should a lubrication accident occur, then the coating will reduce friction. In addition, in a preferred embodiment of the invention, the coating includes submicron-sized grains 10 of $Cr_3C_2$ preferably constituting 2% by weight of the $Cr_3C_2$.

These grains 10 perform a protective role by providing a kind of "dry" lubrication in the vicinity of the surfaces in rotary contact (shaft-bearing).

I claim:

1. A surface coating on martensitic steel for portions that rub in rotation, which surface coating consists essentially of Ni and Mo to provide a matrix of NiMo in which grains of $Cr_3C_2$ are embedded, 90% by weight of the $Cr_3C_2$ being constituted by grains in the range 10 μm to 30 μm.

2. A surface coating according to claim 1, consisting essentially of the following composition by weight:

$Cr_3C_2$: 15% to 25%;

Mo: 15% to 25%;

Ni: 55% to 65%.

3. A surface coating according to claim 2, wherein the grain size of the NiMo matrix is 20 μm to 90 μm.

4. A surface coating according to any one of claims 1, 2 or 3, wherein about 2% by weight of the $Cr_3C_2$ is constituted by submicron grains, said submicron grains being essentially located on a layer of the surface coating for rotary contact.

* * * * *